US007101150B2

(12) United States Patent
Bash et al.

(10) Patent No.: US 7,101,150 B2
(45) Date of Patent: Sep. 5, 2006

(54) FASTENED VANE ASSEMBLY

(75) Inventors: Gary Bash, Jupiter, FL (US); J. Page Strohl, Tequesta, FL (US)

(73) Assignee: Power Systems MFG, LLC, Jupiter, FL (US)

( * ) Notice: Subject to any disclaimer, the term of this patent is extended or adjusted under 35 U.S.C. 154(b) by 111 days.

(21) Appl. No.: 10/842,976

(22) Filed: May 11, 2004

(65) Prior Publication Data

US 2005/0254944 A1 Nov. 17, 2005

(51) Int. Cl.
*F01D 1/02* (2006.01)
*F01D 9/00* (2006.01)

(52) U.S. Cl. ..... 415/191; 415/209.3

(58) Field of Classification Search ..... 415/191, 415/209.3, 209.4, 211.2; 411/544; 464/98
See application file for complete search history.

(56) References Cited

U.S. PATENT DOCUMENTS 4,492,517 A 1/1985 Klompas
5,149,250 A * 9/1992 Plemmons et al. ..... 415/209.3
5,459,995 A 10/1995 Norton et al.
5,618,161 A 4/1997 Papageorgiou et al.
5,667,347 A * 9/1997 Matthews ..... 411/150
5,848,874 A 12/1998 Heumann et al.
6,050,776 A 4/2000 Akagi et al.
6,261,058 B1 * 7/2001 Kataoka et al. ..... 415/189
6,464,456 B1 10/2002 Darolia et al.
6,592,326 B1 * 7/2003 Marx et al. ..... 415/208.2

* cited by examiner

*Primary Examiner*—Edward K. Look
*Assistant Examiner*—Devin Hanan
(74) *Attorney, Agent, or Firm*—Shook, Hardy, & Bacon, LLP

(57) ABSTRACT

A vane assembly for a gas turbine is described wherein the vane assembly comprises a first vane and a second vane connected together by a plurality of flanges, at least one fastener, and at least one spring plate. The fastener and hole diameters in the respective flanges are sized such that the first vane and second vane are essentially pinned together along their inner flanges and allowed to adjust due to thermal growth along their outer flanges, while maintaining a constant seal along both inner and outer platform edges. The thermal growth along the outer flanges is made possible by oversized flange holes relative to the diameter of the fastener.

17 Claims, 7 Drawing Sheets

FIGURE 1 – PRIOR ART

FASTENED VANE ASSEMBLY

TECHNICAL FIELD

The present invention relates generally to gas turbine engines and more specifically to a turbine vane assembly comprising a plurality of individual vanes.

BACKGROUND OF THE INVENTION

A gas turbine engine typically comprises a compressor, combustion system, and turbine, for the purpose of compressing air, mixing it with a fuel and igniting this mixture, and directing the resulting hot combustion gases through a turbine for creating propulsive thrust or rotational energy used for electrical generation. Turbine sections comprise a plurality of stages, where each stage includes a row of stationary airfoils followed by a row of rotating airfoils, where the row of stationary airfoils direct the flow of hot combustion gases onto the row of rotating airfoils at a preferred angle. The rotating airfoils of the turbine are driven by the pressure load from the hot combustion gases passing along the airfoil surface. While the rotating airfoils, or blades, are each individually attached to a turbine disk, which thereby allows each blade to move as necessary due to thermal gradients. However, stationary airfoils, or vanes, are often times manufactured in doublets or triplets, where two or three airfoils are interconnected by common platforms, which also serve as radial seals, such that hot combustion gases cannot leak out of the turbine and are directed towards the turbine blades, thereby increasing the overall turbine efficiency. An example of a prior art turbine vane doublet in accordance with this design is shown in FIG. 1. Turbine vane 10 includes a first airfoil 11, second airfoil 12, each of which are fixed to inner platform 13 and outer platform 14. A plurality of these vane doublets are assembled together in the engine case to form a stage of stationary airfoils.

While this arrangement is desired to prevent leakage of hot combustion gases into the region of turbine cooling air, often times adjacent turbine vane airfoils 11 and 12 have different operating temperatures and temperature gradients depending on the flow of hot combustion gases onto the vane airfoils. These temperature gradients are further affected by the cooling fluid passing through the airfoil section. As a result of this multi-vane configuration, the airfoils cannot respond as individual components thus creating high thermal stresses in vane assembly 10 resulting in severe cracking of airfoils 11 and 12 in a relatively short period of time.

What is needed is a turbine vane assembly arrangement that provides the sealing benefit of a multi-vane configuration while allowing individual airfoils to respond to varying thermal gradients.

SUMMARY AND OBJECTS OF THE INVENTION

A vane assembly for a gas turbine is provided comprising a first vane and second vane wherein the first vane is connected to the second vane along a plurality of flanges by at least one fastener and at least one spring plate. The connection along the flanges is such that the first vane is allowed to respond individually to thermal gradients relative to the second vane. In the preferred embodiment, flanges are located along the cold walls of both the radially inner platform and radially outer platform for the first and second vane and the flanges are joined by at least one fastener and spring plate to ensure that the adjacent platforms are in complete sealing contact and do not require a separate seal between platforms. It is preferred that the inner platforms are essentially pinned together along the inner flanges where the outer platforms, while joined together, are joined such that some movement between the first vane and second vane is allowed as a mechanism to reduce the thermal stress while maintaining an adequate seal along the outer platforms.

It is an object of the present invention to provide a vane assembly having a plurality of airfoils that can respond individually to thermal gradients while minimizing leakage between the airfoils.

It is another object of the present invention to provide a means to connect a plurality of individual vanes together such that no modifications are required to the engine casing.

In accordance with these and other objects, which will become apparent hereinafter, the instant invention will now be described with particular reference to the accompanying drawings.

DETAILED DESCRIPTION OF THE PREFERRED EMBODIMENT

Figure 1:
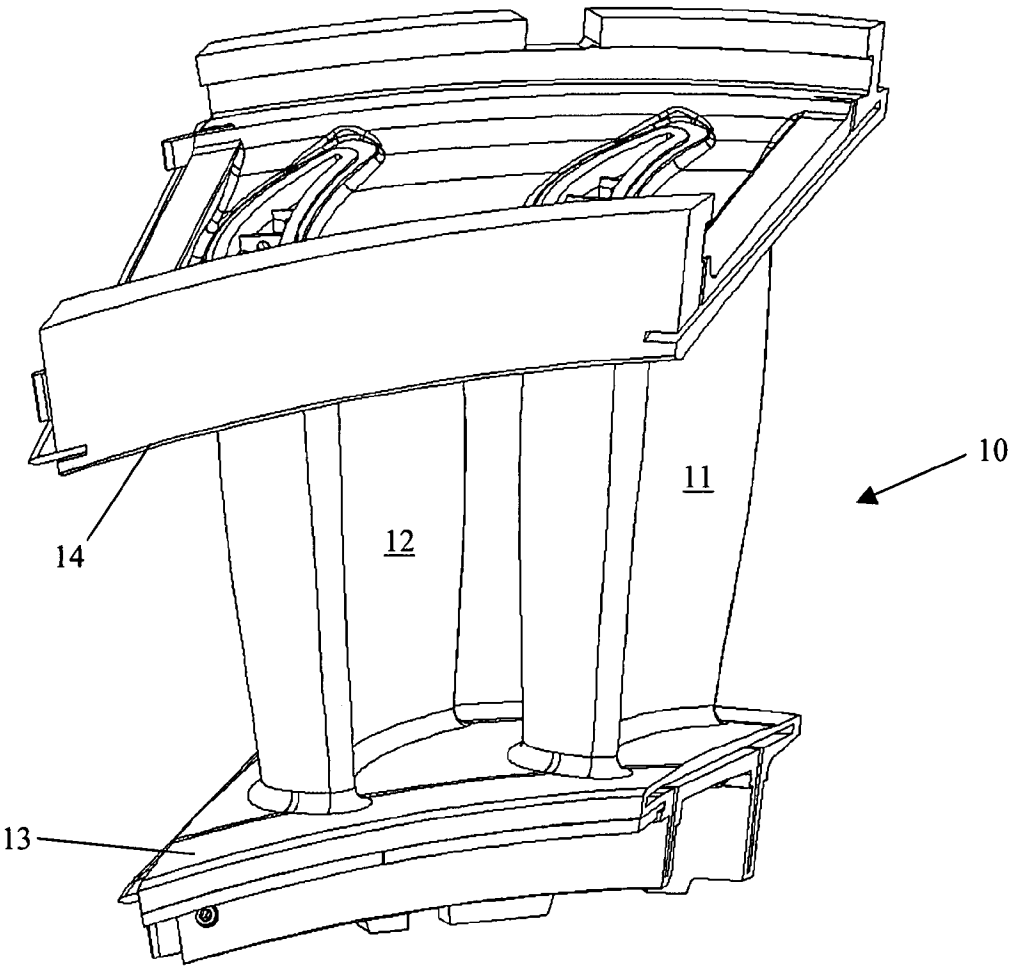
FIG. 1 is a perspective view of a vane assembly of the prior art.
Figure 2:
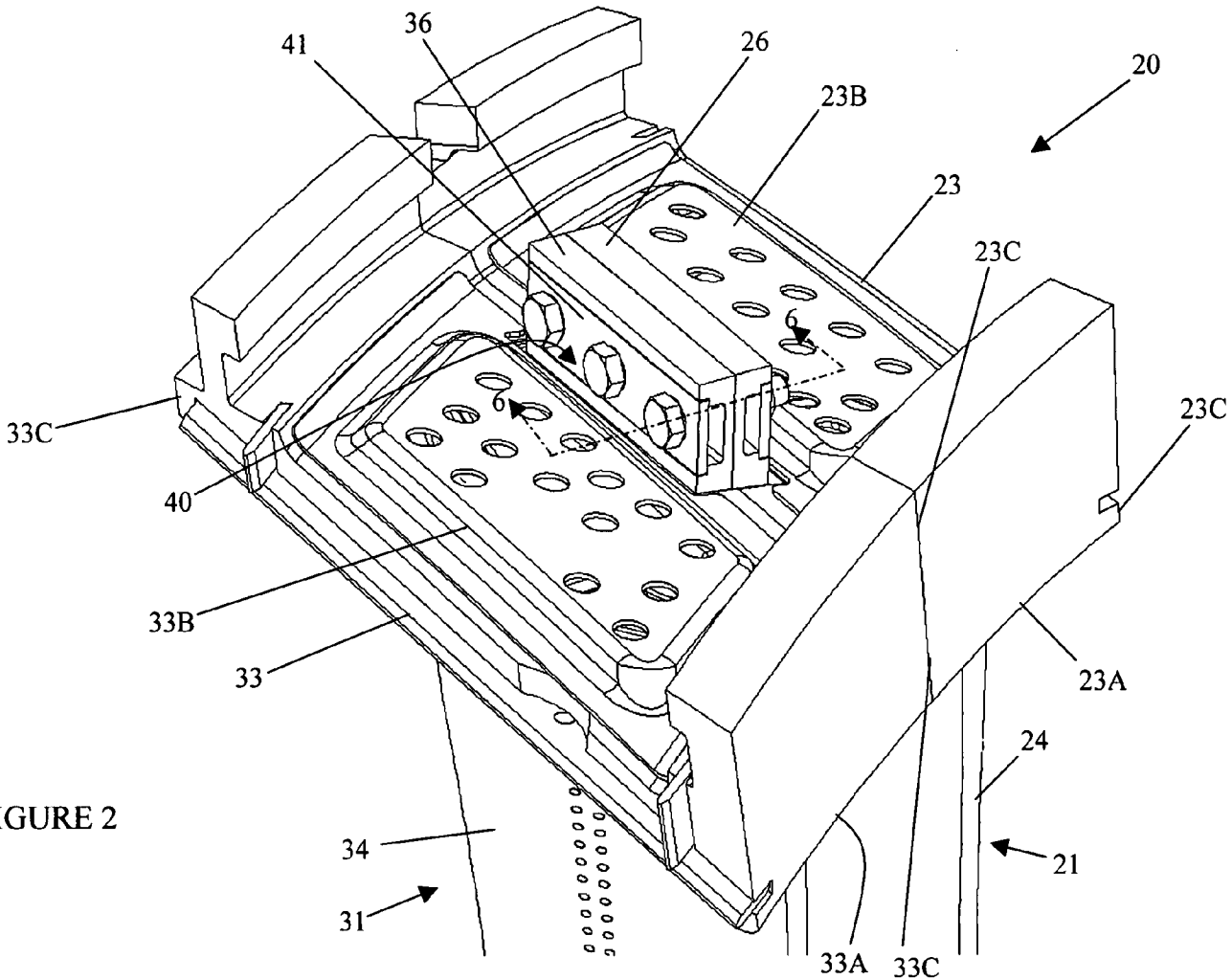
FIG. 2 is a perspective view of an outer platform region of a vane assembly in accordance with the preferred embodiment of the present invention.
Figure 3:
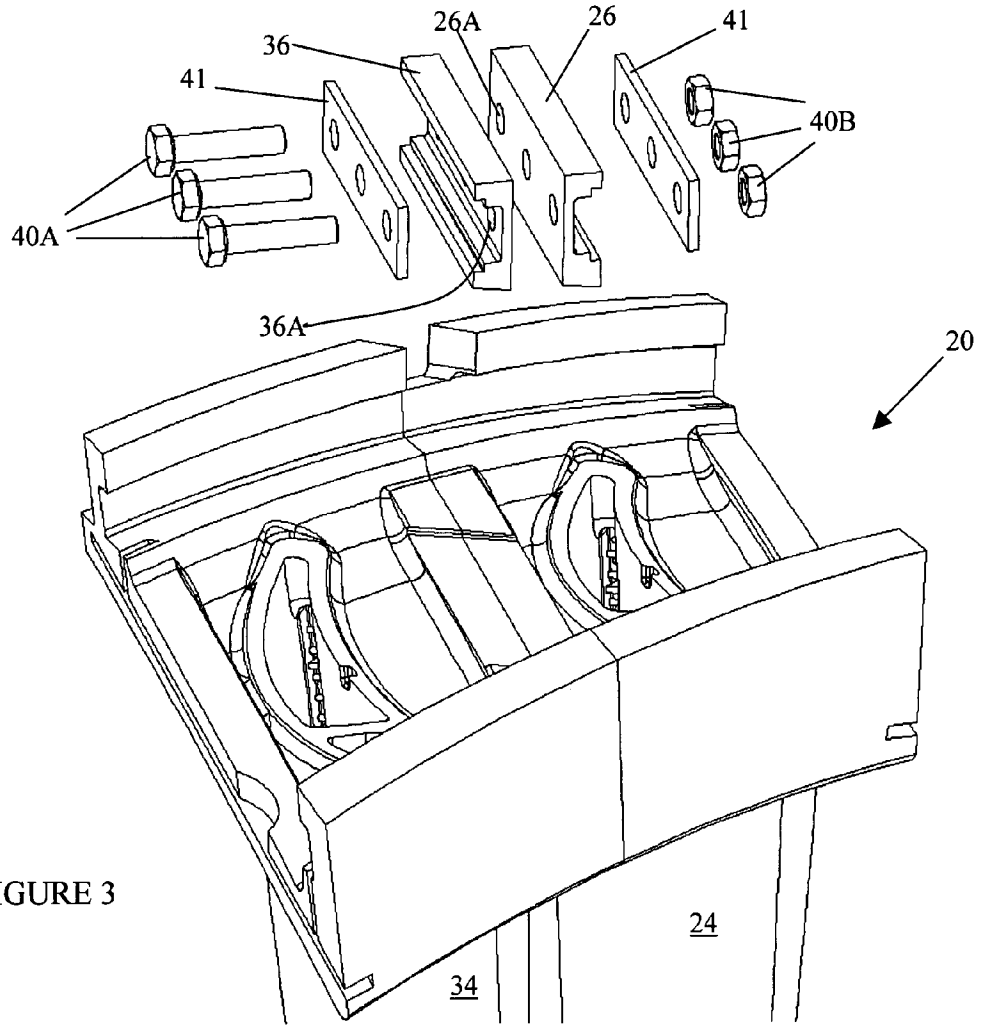
FIG. 3 is a perspective view of an outer platform region depicting a means for connecting first and second vanes in accordance with the preferred embodiment of the present invention.
Figure 4:
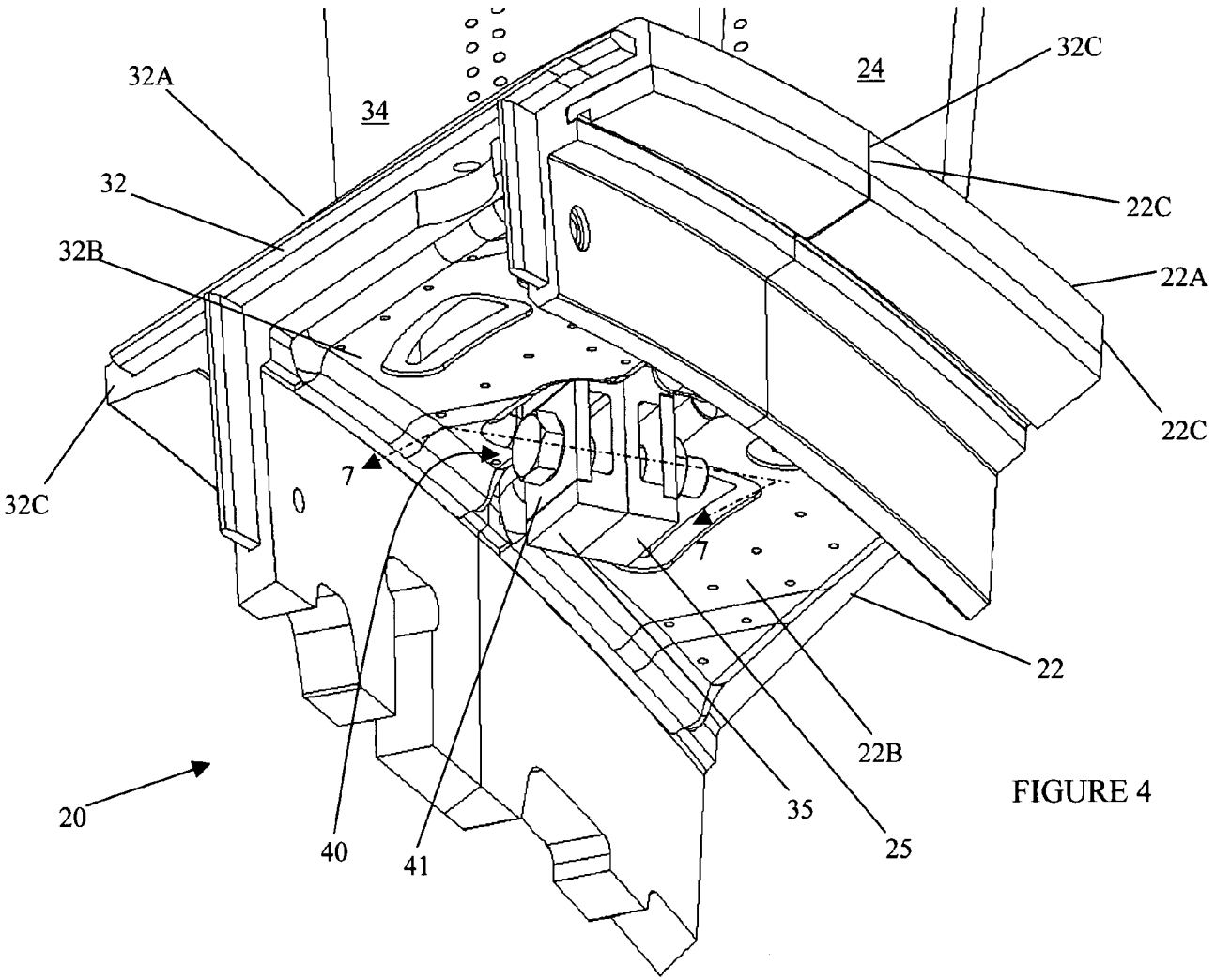
FIG. 4 is a perspective view of an inner platform region of a vane assembly in accordance with the preferred embodiment of the present invention.
Figure 5:
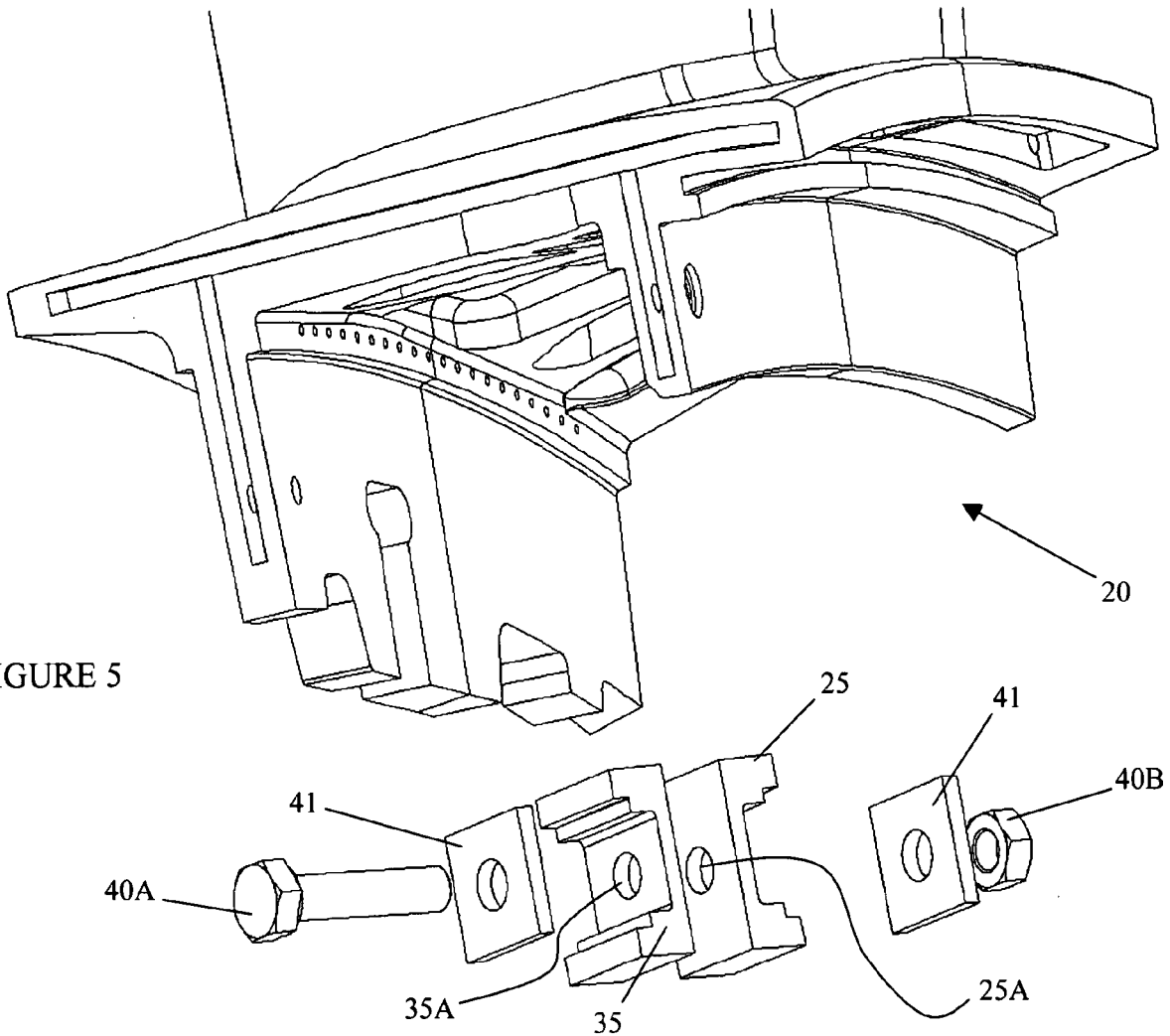
FIG. 5 is a perspective view of an inner platform region depicting a means for connecting first and second vanes in accordance with the preferred embodiment of the present invention.

A vane assembly 20 for a gas turbine in accordance with the preferred embodiment of the present invention is shown in detail in FIGS. 2–7. Vane assembly 20 comprises first vane 21, which in turn, comprises first inner platform 22, first outer platform 23, first airfoil 24, first inner flange 25, and first outer flange 26. First inner platform 22 further comprises first inner hot wall 22A, first inner cold wall 22B, and first inner edge 22C, while first outer platform 23 further comprises first outer hot wall 23A, first outer cold wall 23B, and first outer edge 23C. First airfoil 24 extends generally radially between first inner hot wall 22A and first outer hot wall 23A. First inner flange 25 is fixed to first inner cold wall 22B and has at least one first inner hole 25A having a first inner diameter. Meanwhile, first outer flange 26 is fixed to first outer cold wall 23B and has at least one first outer hole 26A having a first outer diameter. Referring to FIGS. 3 and 5, in the preferred embodiment of the present invention, first inner flange 25 includes one first inner hole 25A, while first outer flange 26 includes three first outer holes 26A. Furthermore, it is also preferred that both first inner flange 25 and first outer flange 26 have a generally C-shaped axial cross section and are welded to their respective platforms of first vane 21. However, first inner flange 25 and first outer flange 26 could be integrally cast into first vane 21 if desired.

Referring back to FIGS. 2–5, vane assembly 20 also comprises second vane 31, which in turn, comprises second inner platform 32, second outer platform 33, second airfoil 34, second inner flange 35, and second outer flange 36. Second inner platform 32 further comprises second inner hot wall 32A, second inner cold wall 32B, and second inner edge 32C, while second outer platform 33 further comprises second outer hot wall 33A, second outer cold wall 33B, and second outer edge 33C. Second airfoil 34 extends generally radially between second inner hot wall 32A and second outer hot wall 33A. Second inner flange 35 is fixed to second inner cold wall 32B and has at least one second inner hole 35A having a second inner diameter. Meanwhile, second outer flange 36 is fixed to second outer cold wall 33B and has at least one second outer hole 36A having a second outer diameter. Referring to FIGS. 3 and 5, in the preferred embodiment of the present invention, second inner flange 35 includes one first inner hole 35A, while second outer flange 36 includes three second outer holes 36A. Furthermore, it is also preferred that both second inner flange 35 and second outer flange 36 have a generally C-shaped cross section and are welded to their respective platforms of second vane 31. However, second inner flange 35 and second outer flange 36 could be integrally cast into second vane 31 if desired.

First vane 21 is preferably connected to second vane 31 along the interface of flanges 25 and 35 and 26 and 36 by at least one fastener 40 having a fastener diameter and at least one spring plate 41 such that first and second inner platforms and first and second outer platforms are in contact along their respective edges. Preferably, fastener 40 consists of bolt 40A and nut 40B, as best shown in FIGS. 3 and 5. In order to fix first and second vanes properly while simultaneously allowing for the necessary thermal growth between first vane 21 and second vane 31, it is desirable to essentially pin the inner flanges together while allowing the outer flanges to adjust as necessary while maintaining a seal along first and second outer edges.

Figure 6:
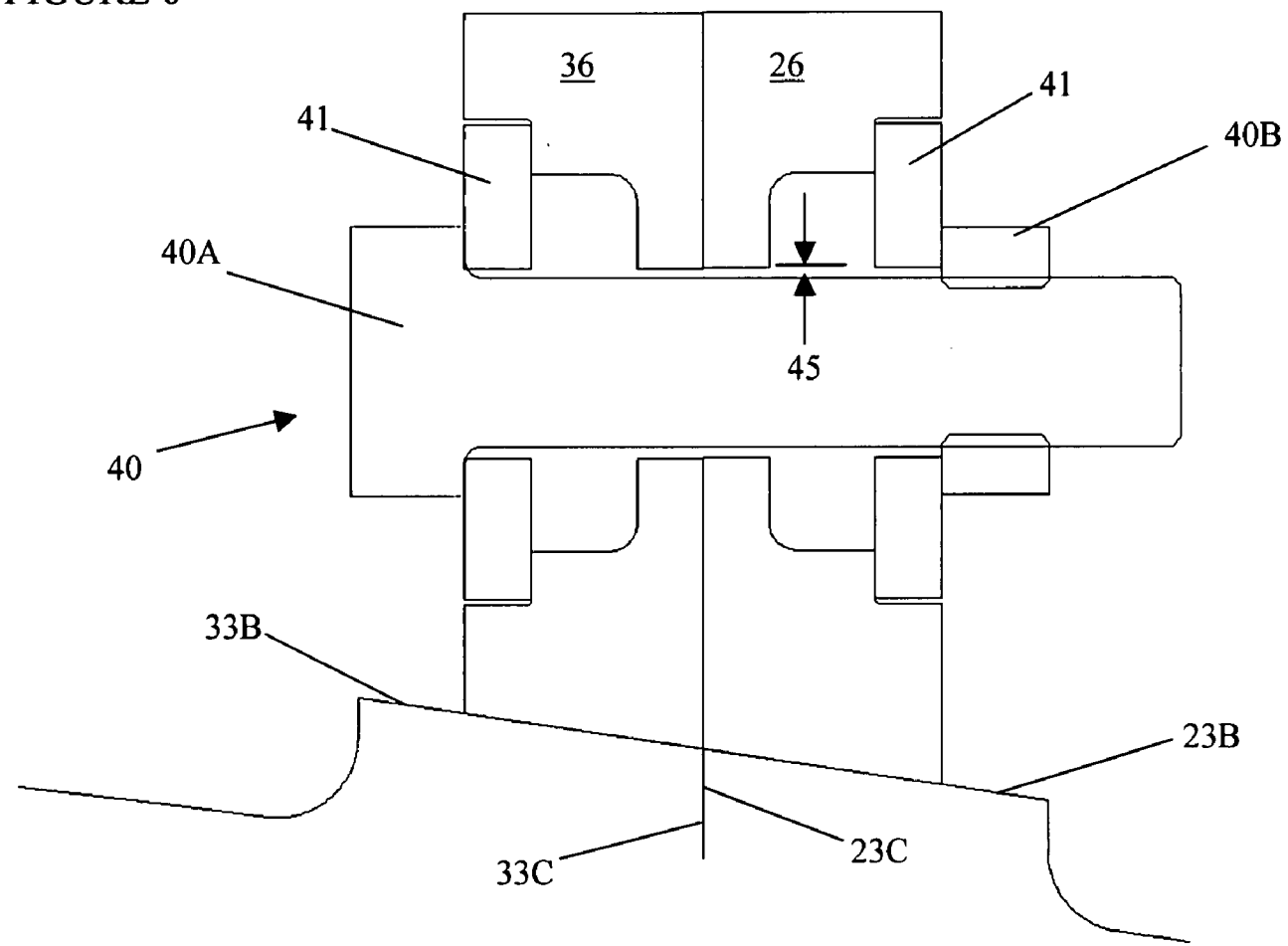
FIG. 6 is a cross section taken through an outer platform means for connecting first and second vanes in accordance with the preferred embodiment of the present invention.

The assembly of first vane 21 to second vane 31 at first outer flange 26 and second outer flange 36 is shown in cross section in FIG. 6. Bolt 40A passes through at least one spring plate 41 and through mating flanges 26 and 36 and is fastened to flanges 26 and 36 by nut 40B. First outer diameter of first outer hole 26A and second outer diameter of second outer hole 36A are larger than fastener 40, thereby forming an outer flange gap 45 between fastener 40 and first and second outer diameters. Outer flange gap 45 allows for first outer flange 26 and second outer flange 36 to slide as necessary to accommodate thermal growth while maintaining a complete seal along first outer edge 23C and second outer edge 33C.

Figure 7:
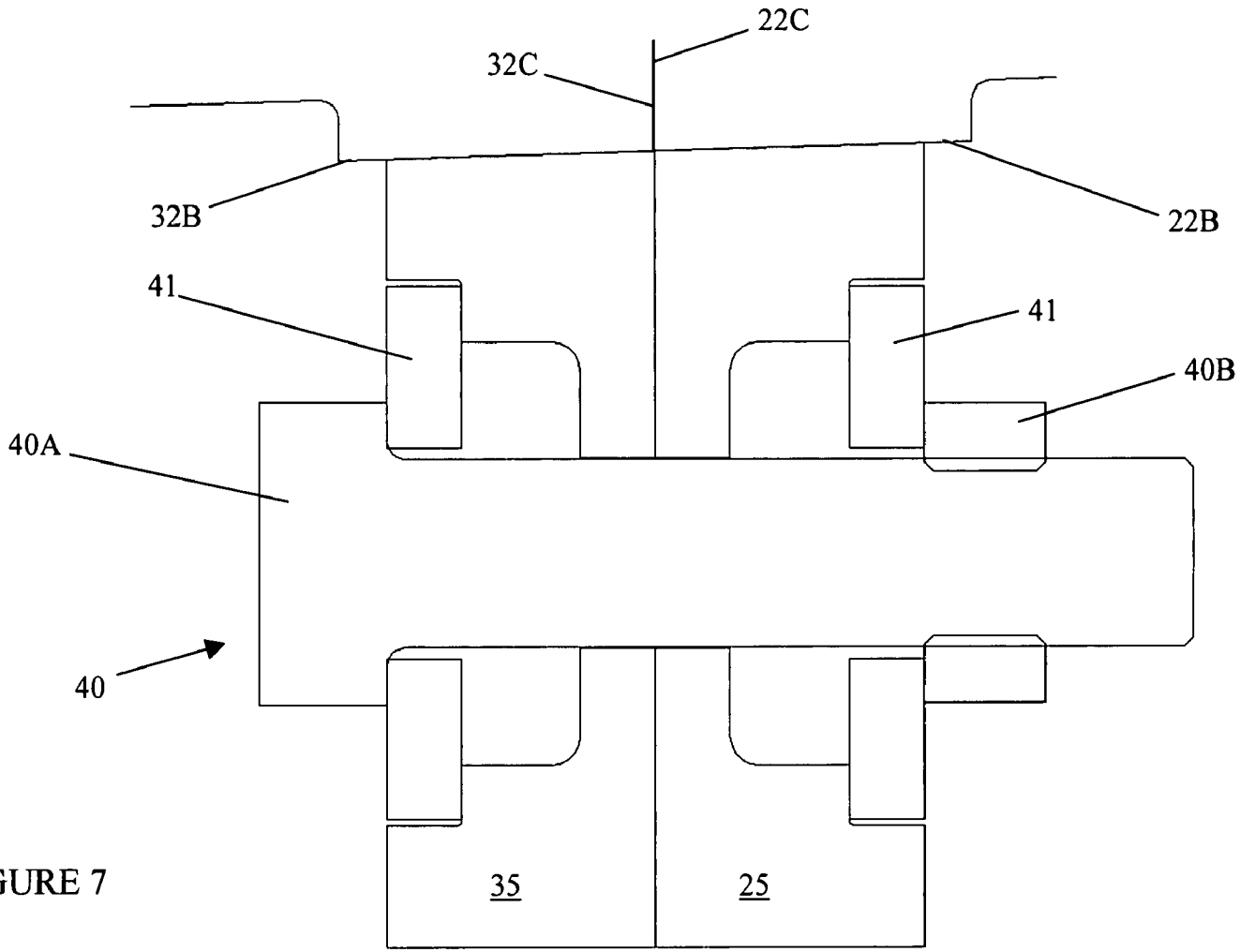
FIG. 7 is a cross section taken through an inner platform means for connecting first and second vanes in accordance with the preferred embodiment of the present invention.

The assembly of first vane 21 to second vane 31 at first inner flange 25 and second inner flange 35 is shown in cross section in FIG. 7. Bolt 40A passes through at least one spring plate 41 and through mating flanges 25 and 35 and is fastened to flanges 25 and 35 by nut 40B. First inner diameter of first inner hole and second inner diameter of second inner hole are substantially equal to fastener 40 such that first vane 21 and second vane 31 are pinned together along first inner flange 25 and second inner flange 35. Pinning the inner flanges together directs all thermal growth due to the thermal gradients in a generally radially outward direction.

A further benefit of the preferred means for connecting first vane 21 to second vane 31 is with respect to the turbine case in which the vane assembly is mounted. Connecting first vane 21 and second vane 31 with a plurality of flanges positioned along cold walls of the platform does not interfere with any existing features of the turbine case or vane assembly used to position and secure the vane assembly to the turbine case.

Depending on the location of the vane assembly and its respective operating temperatures, often times the vane assembly must have a thermal barrier coating (TBC) applied to the airfoil to protect the base metal from direct exposure to the hot combustion gases. An additional benefit to the vane assembly of the present invention is with respect to the application of the TBC. By splitting the vane assembly, each vane can be coated individually, thereby ensuring that all airfoil surfaces receive the required amount of TBC. Prior art vane assemblies often times experienced difficulty in achieving a uniform coating due to the adjacent airfoil obscuring the line of sight of the coating apparatus.

One skilled in the art of vane assembly design will understand that the preferred embodiment disclosed the mating of a first and second vane. However, this application can be applied to more than only two vanes at a time. Two vanes were shown for simplicity of explaining the present invention.

While the invention has been described in what is known as presently the preferred embodiment, it is to be understood that the invention is not to be limited to the disclosed embodiment but, on the contrary, is intended to cover various modifications and equivalent arrangements within the scope of the following claims.

What we claim is:

1. A vane assembly for a gas turbine, said assembly comprising:

a first vane comprising:

a first inner platform comprising a first inner hot wall, a first inner cold wall, and a first inner edge;

a first outer platform comprising a first outer hot wall, a first outer cold wall, and a first outer edge;

a first airfoil extending between said first inner hot wall and said first outer hot wall;

a first inner flange fixed to said first inner cold wall and having at least one first inner hole having a first inner diameter;

a first outer flange fixed to said first outer cold wall and having at least one first outer hole having a first outer diameter;

a second vane comprising:

a second inner platform comprising a second inner hot wall, a second inner cold wall, and a second inner edge;

a second outer platform comprising a second outer hot wall, a second outer cold wall, and a second outer edge;

a second airfoil extending between said second inner hot wall and said second outer hot wall;

a second inner flange fixed to said second inner cold wall and having at least one second inner hole having a second inner diameter;

a second outer flange fixed to said second outer cold wall and having at least one second outer hole having a second outer diameter; and wherein said first vane is connected to said second vane along said flanges by at least one fastener having a fastener diameter, and at least one spring plate.

2. The vane assembly of claim 1 wherein said first outer diameter and said second outer diameter are larger than said fastener diameter, thereby forming an outer flange gap between said fastener and said first and second outer diameters.

3. The vane assembly of claim 1 wherein said first inner diameter and said second inner diameter are substantially equal to said fastener diameter such that said first vane and said second vane are pinned together at said first and second inner flanges.

4. The vane assembly of claim 1 wherein said fastener consists of a bolt and nut.

5. The vane assembly of claim 1 wherein said flanges are welded to said outer walls of said platforms.

6. The vane assembly of claim 1 wherein said first inner flange includes one first inner hole.

7. The vane assembly of claim 6 wherein said first outer flange includes three first outer holes.

8. The vane assembly of claim 1 wherein said second inner flange includes one first inner hole.

9. The vane assembly of claim 8 wherein said second outer flange includes three first outer holes.

10. The vane assembly of claim 1 wherein each of said flanges has a generally C-shaped axial cross section.

11. A vane assembly for a gas turbine, said assembly comprising:

a first vane comprising:

a first inner platform comprising a first inner hot wall, a first inner cold wall, and a first inner edge;

a first outer platform comprising a first outer hot wall, a first outer cold wall, and a first outer edge;

a first airfoil extending between said first inner hot wall and said first outer hot wall;

a second vane comprising:

a second inner platform comprising a second inner hot wall, a second inner cold wall, and a second inner edge;

a second outer platform comprising a second outer hot wall, a second outer cold wall, and a second outer edge;

a second airfoil extending between said second inner hot wall and said second outer hot wall;

a plurality of flanges fixed to said outer walls of said platforms;

a plurality of spring plates; and, a plurality of fasteners, each of said fasteners having a fastener diameter, and each of said fasteners passing through at least one of said spring plates and two of said flanges.

12. The vane assembly of claim 11 wherein said plurality of flanges consists essentially of:

a first inner flange fixed to said first inner cold wall and having at least one first inner hole having a first inner diameter;

a first outer flange fixed to said first outer cold wall and having at least one first outer hole having a first outer diameter;

a second inner flange fixed to said second inner cold wall and having at least one second inner hole having a second inner diameter; and, a second outer flange fixed to said second outer cold wall and having at least one second outer hole having a second outer diameter.

13. The vane assembly of claim 12 wherein said first outer diameter and said second outer diameter are larger than said fastener diameter, thereby forming an outer flange gap between said fastener and said first and second outer diameters.

14. The vane assembly of claim 12 wherein said first inner diameter and said second inner diameter are substantially equal to said fastener diameter such that said first vane and said second vane are pinned together at said first and second inner flanges.

15. The vane assembly of claim 12 wherein said fastener consists of a bolt and nut.

16. The vane assembly of claim 12 wherein said flanges are welded to said outer walls of said platforms.

17. The vane assembly of claim 12 wherein each of said flanges has a generally C-shaped axial cross section.

* * * * *